United States Patent [19]

Landa et al.

[11] 4,372,826

[45] Feb. 8, 1983

[54] ELECTROLYTE FOR CATHODIC DEPOSITION OF NICKEL ALLOYS WITH IRON

[75] Inventors: Vaclav Landa; Jaromir Vitek; Pavel Nejedly; Vladimir Holpuch, all of Prague, Czechoslovakia; Juozas Bubelis; Atanas-Nemezyus Stepanovicius, both of Vilnius, U.S.S.R.

[73] Assignee: Statni vyzkumny ustav materialu, Prague, Czechoslovakia

[21] Appl. No.: 260,936

[22] Filed: May 6, 1981

[30] Foreign Application Priority Data

Mar. 7, 1980 [CS] Czechoslovakia ..... PV 1609

[51] Int. Cl.[3] ..... C25D 3/56

[52] U.S. Cl. ..... 204/43 T

[58] Field of Search ..... 204/43 T, 123

[56] References Cited

U.S. PATENT DOCUMENTS 3,806,429 4/1974 Clauss et al. ..... 204/41

4,129,482 12/1978 Lash ..... 204/43 T

FOREIGN PATENT DOCUMENTS 28953 of 1912 United Kingdom ..... 204/43 T 2078257 1/1982 United Kingdom ..... 204/43 T

*Primary Examiner*—G. L. Kaplan

[57] ABSTRACT

An electrolyte for the deposition of nickel alloys with iron in the range from 3 to 30% by weight of iron. This electrolyte is based on nickel(II)- and iron(II) sulphosalicylate, with an admixture of a halide, for example potassium iodide, further an admixture of a wetting agent, for example sodium laurylsulphate, and an admixture of a compound with a buffer effect, for example boric acid.

7 Claims, No Drawings

ELECTROLYTE FOR CATHODIC DEPOSITION OF NICKEL ALLOYS WITH IRON

The invention is related to an electrolyte for the deposition of nickel alloys with iron in the range from 3 to 80% by weight of iron.

Nickel sulphates or chlorides, and optionally their combinations, are the basic part of the up-to-now known electrolytes for the cathodic deposition of nickel alloys with iron. Electrolytes for this purpose have also been disclosed wherein amidosulphonate, fluoroborate, or eventually others were the basic anions. All of the prior electrolytes described which do not use further ingredients form a complex with trivalent iron. But even thin layers cannot be deposited from such electrolytes due to the fact that the deposited alloys have a very high internal stress so that cracking of the coatings takes place at the time of their electo-deposition. The use of compounds reducing macrostress brings with it some drawbacks, such as the possibility of the formation of byproducts of the electrolysis which can negatively affect the quality of the coatings, as by the formation of a fine lamellar structure which can lead in some cases to the separation of the deposited alloy into layers parallel with the cathode surface, and the like.

The above-mentioned drawbacks are eliminated by an electrolyte for the cathodic deposition of nickel alloys with iron according to the present invention. In accordance with the invention the electrolyte is composed of an aqueous solution of nickel/II/ sulphosalicylate in a concentration of from 0.1 to $1.05\times10^3$ mole.m$^{-3}$ and an iron salt, for example of iron/II/ sulphosalicylate, in a concentration from 0.01 to $0.30\times10^3$ mole.m$^{-3}$. According to a further feature of the invention, the electrolyte contains an admixture of halide, for example potassium iodide, in a concentration from 0.01 to $0.01\times10^3$ mole.m$^{-3}$. The electrolyte preferably contains an admixture of wetting agent, for example sodium laurylsulphate, dialkylnaphthalene sulphonic acid, in an amount from 0.01 to 1.0 g/1. According to a still further feature, the electrolyte contains an admixture of a compound with a buffer effect, for example boric acid, in a concetration of from 0.1 to $0.4\times10^3$ mole.m$^{-3}$.

The electrolyte according to the invention, which consists principally of nickel and iron sulphosalicylates, is characterized by its considerable simplicity. Layers of metal deposited therefrom have a very low level of macrostress over wide concentration limits (as far as the content of the single components in the alloy is concerned) the layers having a less pronounced lamellar structure with cross crystallites.

It is advantageous to add a small amount of a suitable halide to the electrolyte in order to ensure a proper anodic regime. The basic components, this is nickel/II/ and iron/II/ sulphosalicylate are easily accessible by dissolving basic nickel/II/ carbonate respectively carbonyl iron in a sulphosalicylic acid solution. The electrolyte operates best with a total concentration of electroactive cations within the limits of from 0.5 to $1\times10^3$ mole.m$^{-3}$. The utilizable current densities are between 2 and 15 A.dm$^{-2}$, and temperatures of the electrolyte lie between 30° and 80° C. The pH values are from 2.5 to 5.5. The cathodic current yield reaches 85% under these conditions. It is not necessary to add any other ingredients to the electrolyte in order to suppress hydrogen pitting; it is possible to use a suitable wetting agent such as 1,6-diisopropylnaphthalene-3-sulphonic acid, sodium laurylsulphate and the like in an amount up to 1 g/1; optionally it is possible to use compounds with a buffer effect, such as boric acid in a concentration up to $0.4\times10^3$ mole.m$^{-3}$.

The invention is further illustrated by the following three examples, which are not to be construed as limiting and as exhausting the scope of the invention.

EXAMPLE 1

The electrolyte was composed of:

$0.56\times10^3$ mole.m$^{-3}$ nickel/II/ sulphosalicylate, and $0.24\times10^3$ mole.m$^{-3}$ iron/II/ sulphosalicylate.

The cathodic current density was 10 A.dm$^{-2}$, the pH=4, and bath temperature was 60° C.

The value of the macrostress was 172 MPa; the iron content in the deposited layer 61% by weight.

EXAMPLE 2

The electrolyte was composed of:

$0.7\times10^3$ mole.m$^{-3}$ nickel/II/ sulphosalicylate, $0.1\times10^3$ mole.m$^{-3}$ iron/II/ sulphosalicylate, and $0.05\times10^3$ mole.m$^{-3}$ potassium bromide.

The cathodic current density was 5 A.dm$^{-2}$, the pH=4, and bath temperature was 50% C.

The value of the macrostress was 129.7 MPa; the iron content in the deposited layer 14.5% by weight.

EXAMPLE 3

The electrolyte was composed of:

$0.77\times10^3$ mole.m$^{-3}$ nickel/II/ sulphosalicylate, $0.03\times10^3$ mole.m$^{-3}$ iron/II/ sulphosalicylate, $0.08\times10^3$ mole.m$^{-3}$ potassium iodide, and 0.2 g/l sodium laurylsulphate.

The cathodic current density was 5 A.dm$^{-2}$, the pH=3.1, and bath temperature was 50° C.

The value of the macrostress was 122.6 MPa; the iron content in the layer 7.5% by weight.

Although the invention is illustrated and described with reference to a plurality of preferred embodiments thereof, it is to be expressly understood that it is in no way limited to the disclosure of such preferred embodiments but is capable of numerous modifications within the scope of the appended claims.

We claim:

1. An electrolyte for the cathodic deposition of nickel alloys with iron, comprising an aqueous solution of nickel/II/ sulphosalicylate in a concentration from 0.1 to $1.05\times10^3$ mole.m$^{-3}$ and iron/II/ sulphosalicylate, in a concentration from 0.01 to $0.30\times10^3$ mole.m$^{-3}$.

2. An electrolyte according to claim 1, wherein the electrolyte contains an admixture of a halide, in a concentration from 0.01 to $0.1\times10^3$ mole.m$^{-3}$.

3. An electrolyte according to claim 2, wherein the halide is potassium iodide.

4. An electrolyte according to claim 1, wherein the electrolyte contains an admixture of a wetting agent, in the amount from 0.01 to 1.0 g/l.

5. An electrolyte according to claim 4, wherein the wetting agent is chosen from the group consisting of sodium laurylsulphate and dialkynaphthalene sulphonic acid.

6. An electrolyte according to claim 1, wherein the electrolyte contains an admixture of a compound with a buffer effect in a concentration of from 0.01 to $0.4\times10^3$ mole.m$^{-3}$.

7. An electrolyte according to claim 6, wherein the compound with a buffer effect is boric acid.

* * * * *